US011217936B2

(12) United States Patent
Irwin et al.

(10) Patent No.: US 11,217,936 B2
(45) Date of Patent: Jan. 4, 2022

(54) STRAIN RELIEF DEVICES FOR COMMUNICATION CONNECTORS

(71) Applicant: Panasonic Avionics Corporation, Lake Forest, CA (US)

(72) Inventors: Donald Earl Irwin, Rancho Santa Margarita, CA (US); Michael Keith Hertstein, Irvine, CA (US)

(73) Assignee: PANASONIC AVIONICS CORPORATION, Lake Forest, CA (US)

( * ) Notice: Subject to any disclaimer, the term of this patent is extended or adjusted under 35 U.S.C. 154(b) by 34 days.

(21) Appl. No.: 16/781,728

(22) Filed: Feb. 4, 2020

(65) Prior Publication Data

US 2021/0242624 A1 Aug. 5, 2021

(51) Int. Cl.
*H01R 13/58* (2006.01)

(52) U.S. Cl.
CPC ..... *H01R 13/5812* (2013.01)

(58) Field of Classification Search
CPC ..... H01R 13/5812; H01R 13/5804; H01R 13/582; H01R 13/58; H01R 13/5841; H01R 13/5829
USPC ..... 439/464–473
See application file for complete search history.

(56) References Cited

U.S. PATENT DOCUMENTS 3,889,909 A * 6/1975 Koscik ..... F16L 5/00 248/56
4,786,260 A * 11/1988 Spaulding ..... H01R 13/424 29/861
5,246,376 A 9/1993 Schuhl et al.
5,443,065 A * 8/1995 Berghoff ..... A61N 1/3625 439/380
5,596,486 A * 1/1997 Young ..... G06K 19/077 361/737
5,731,546 A * 3/1998 Miles ..... H01R 9/2416 174/135
6,170,784 B1 * 1/2001 MacDonald ..... H05K 7/1448 211/26
7,241,173 B2 7/2007 Callahan et al.
7,465,182 B1 * 12/2008 McDonald ..... H01R 13/6392 439/369
7,927,126 B1 * 4/2011 Bender ..... B01J 19/081 439/369
8,500,483 B2 * 8/2013 Heise ..... H01R 9/032 439/460
9,391,402 B2 * 7/2016 Lin ..... H01R 13/639
10,516,233 B2 * 12/2019 Church-Diciccio ..... H01R 13/5812

(Continued)

FOREIGN PATENT DOCUMENTS

CN 203721978 U 7/2014
DE 202019101080 U1 4/2019
FR 2603746 A1 3/1988

*Primary Examiner* — Travis S Chambers
(74) *Attorney, Agent, or Firm* — Perkins Coie LLP

(57) ABSTRACT

The present disclosure relates to strain relief devices for communication connectors. The strain relief devices are configured to couple to the communication connectors via existing fastener components (e.g., screw receivers), and support optic fiber and/or other cables that extend from the communication connectors at a desired position. The strain relief devices prevent the cables from being damaged by a lack of sufficient support during installation, removal, use, repair, and/or transport.

16 Claims, 10 Drawing Sheets

(56) References Cited

U.S. PATENT DOCUMENTS

| | | | | |
|---|---|---|---|---|
| 2007/0178749 | A1* | 8/2007 | Hoffman | H01R 13/5808<br>439/471 |
| 2015/0296652 | A1 | 10/2015 | Rossman | |

* cited by examiner

STRAIN RELIEF DEVICES FOR COMMUNICATION CONNECTORS

BACKGROUND

Technical Field

This disclosure generally relates to devices that provide strain relief for communication connectors and cables extending from communication connectors.

Related Art

Communication connectors, such as rack and panel connectors configured to conform to the ARINC 600 specifications established by Aeronautical Radio, Inc. are used in airplanes and other vehicles and structures to transmit power and/or data signals. Cable assemblies coupled to and extending out of the connectors can become damaged during installation, use, repair, removal, and/or transport of the connectors due to a lack of sufficient support, especially with respect to optical fiber cables that are relatively thin and brittle. The damage to the cable assemblies tend to occur near the connection point where the cables with the contact pins couple to the communication connector, and can cause signal distortion or loss. The cables can be damaged and even snap at the contacts pins of the connectors due to a lack of sufficient strain relief. Repair and/or replacement of damaged cables and contact pins can be very costly, and can be avoided by providing adequate strain relief for the cables connected to the communication connectors.

As such, there is a need for devices to support cables in a low profile environment to prevent damage and/or breakage during installation, use, repair, removal, and/or transport of communication connectors.

The present disclosure is directed toward one or more improved features identified below, and to devices that address the above-mentioned problems.

SUMMARY

Strain relief devices for communication connectors are disclosed herein. Each strain relief device comprises a base portion, a cable receiving portion, and an arm portion extending between the base portion and the cable receiving portion. The base portion is configured to couple with the communication connector via a first fastener, for example, a screw with male threading, an adhesive, or a weld.

In some contemplated embodiments, the base portion comprises a first fastener component (e.g., a screw receiving through-hole with or without internal threading) that aligns with a second fastener component of the communication connector. This allows a user to utilize fastener components already existing on the communication connector to attach a strain relief device thereto. For example, a user may remove a fastener (e.g., screw) from a fastener component of the communication connector, align a fastener component of the strain relief device with the fastener component the screw was removed from, and insert a longer screw fastener into the aligned fastener components of the strain relief device and communication connector.

The cable receiving portion is positioned away from the communication connector (e.g., at least an inch, at least 1.5 inches, at least 2 inches, at least 2.5 inches, at least 3 inches away from the communication connector) when the base portion is coupled to the communication connector. The cable receiving portion is sized and dimensioned to receive a set of cables (e.g., 1 cable, 2 or more cables, at least 5 cables, at least 8 cables) extending from a first side of the communication connector, and could comprise a clamp, a ring, a piece of material with openings for receiving one or more cables, or any other suitable component that can support a set of cables.

Advantageously, the devices disclosed herein are configured to remain coupled to the communication connectors with cables as they are installed, removed, and/or transported as a unit. Thus, the communication connectors can be removed from a rack tray while the fiber, data, and/or power cables extending from the connectors are supported by the strain relief devices at about 1-5 inches from the back face of the connector. The devices protect cables, even fragile optic fiber cables, from breaking during turbulence and transport by supporting the cables away from the communication connector to provide strain relief.

Other advantages and benefits of the disclosed system and methods will be apparent to one of ordinary skill with a review of the following description.

BRIEF DESCRIPTION OF THE DRAWINGS

The details of embodiments of the present disclosure, both as to their structure and operation, can be gleaned in part by study of the accompanying drawings, in which like reference numerals refer to like parts, and in which.

Figure 1A:
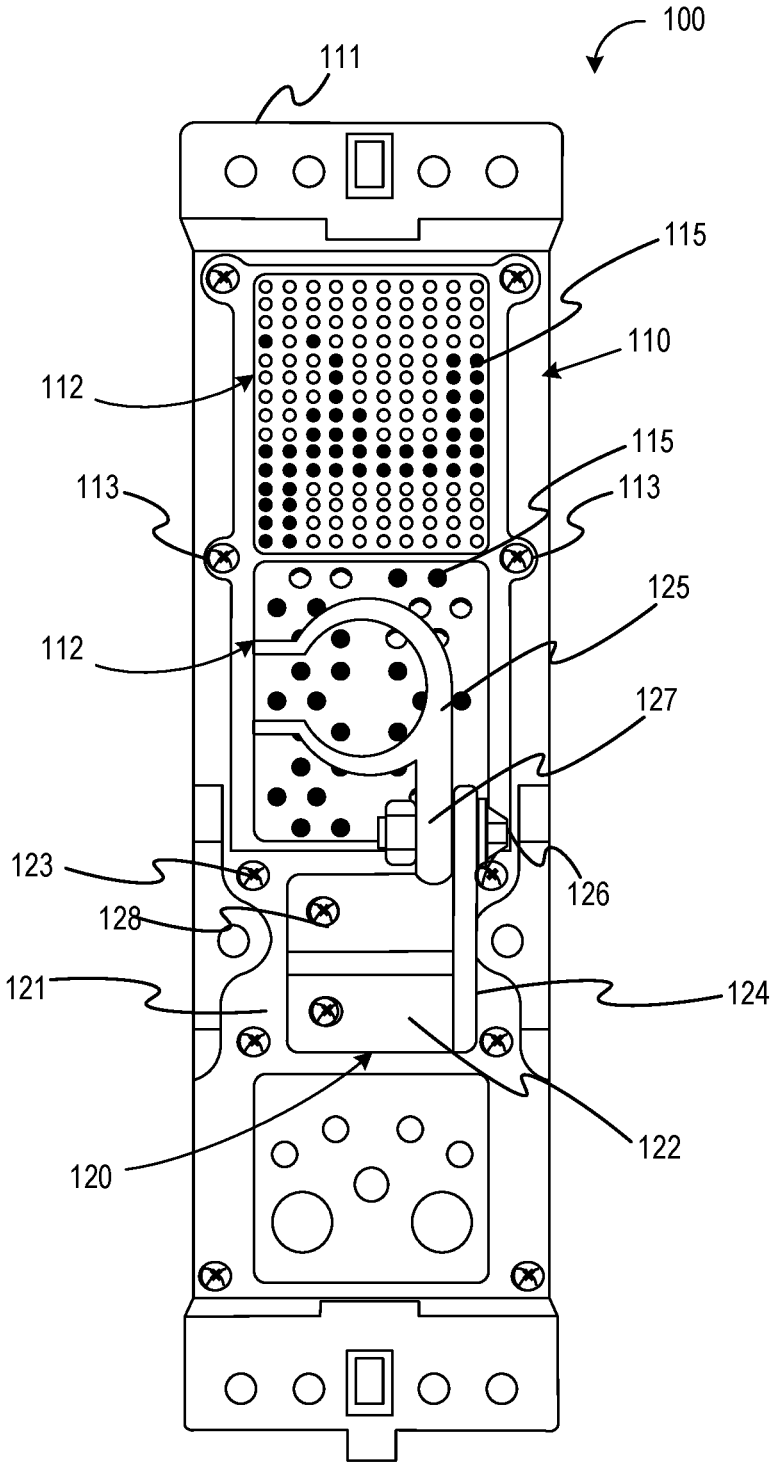
FIG. 1A is a rear view of a communication connector illustrating a strain relief device coupled to the rear face of a communication connector, according to an embodiment.

The drawings illustrate different strain relief devices that can be used depending on, among other things, cable placement within the communication connector, and the relevant application(s).

DETAILED DESCRIPTION

The detailed description set forth below, in connection with the accompanying drawings, is intended as a description of various embodiments and is not intended to represent the only embodiments in which the disclosure may be practiced. The detailed description includes specific details for the purpose of providing a thorough understanding of the embodiments. However, it will be apparent that those skilled in the art will be able to understand the disclosure without these specific details. In some instances, well-known structures and components are shown in simplified form for brevity of description. Some of the surfaces have been left out or exaggerated for clarity and ease of explanation.

Reference throughout this specification to "an embodiment" or "an implementation" means that a particular feature, structure, or characteristic described in connection with the embodiment is included in at least one embodiment or implementation. Thus, appearances of the phrases "in an embodiment" in various places throughout this specification are not necessarily all referring to the same embodiment or a single exclusive embodiment. Furthermore, the particular features, structures, or characteristics described herein may be combined in any suitable manner in one or more embodiments or one or more implementations.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

The recitation of ranges of values herein is merely intended to serve as a shorthand method of referring individually to each separate value falling within the range, and including the endpoints. Unless otherwise indicated herein, each individual value is incorporated into the specification as if it were individually recited herein.

The present disclosure is directed to strain relief devices for communication connectors such as electrical and optical connectors that transmit data signals and power. The communication connectors may comprise rack and panel connectors, which are configured to conform to the ARINC 600 specifications established by Aeronautical Radio, Inc.

Each strain relief device comprises a base portion, a cable receiving portion, and an arm portion extending between the base portion and the cable receiving portion. The base portion may be continuous with the arm portion, or may be a separate piece of material coupled to the arm portion and/or other portion. For example, a material that forms the arm portion may bend at about a 150 degree angle, about a 120 degree angle, about a 90 degree angle, about a 60 degree angle, or about a 30 degree angle to form a base portion. Additionally or alternatively, the bent segment that is substantially orthogonal to the arm portion may be coupled to a separate piece of material that acts as the base portion. In such embodiments, the bent segment may be referred to as a "connector portion" as it couples two components together (here, the arm portion and the base portion). The separate piece of material that acts as the base portion may be flatter and/or larger than the bent segment, or otherwise more suitable for coupling to the communication connector via a fastener.

As used herein, the terms "about" and "substantially" means within 10%. Thus, the term "about 90 degrees" means between 81-99 degrees, inclusive.

The base portion is configured to permanently or removably attach and/or otherwise couple with the communication connector via one or more fasteners. In some aspects, the base portion comprises a fastener component that aligns with a fastener component of the communication connector. All suitable fastener components are contemplated, which are sized and dimensioned to mate and/or fasten with a fastener. For example, where a fastener comprises a screw with male threading, the fastener component(s) may comprise a through-hole, a recess, a through-hole with internal threading, and/or a recess with internal threading. It is contemplated that user may utilize fastener components existing on the communication connector to attach a strain relief device thereto.

An arm portion, which may comprises one or more pieces of material, extends between the base portion and the cable receiving portion, and can have an effective length of between 0.25 and 5 inches, 0.25 and 3 inches, 0.25 and 2.5 inches, 0.5 and 3 inches, 1-2.5 inches, or any other suitable length. The "effective length" of the arm is the straight line distance between the side of the base portion facing away from the communication connector and the point where the cables extending from the communication cable contacts the cable receiving portion. Thus, where an arm portion is bent, overlapping, and/or curved, an actual length of the arm portion may be longer than the effective length of the arm portion.

An ideal effective length of an arm portion may depend on, among other things, the number of cables the cable receiving portion is configured to hold, the types of cables the cable receiving portion is configured to hold, and/or the material(s) of the strain relief device.

With the arm portion extending between the base portion and cable receiving portion, the cable receiving portion is positioned away from the communication connector when the base portion is coupled to the communication connector. The cable receiving portion may be positioned at least 0.25 inches, at least 0.5 inches, at least 1 inch, at least 1.5 inches, at least 2 inches, at least 2.5 inches, or at least 3 inches away from the communication connector. Viewed from a different perspective, at least 0.25 inches, at least 0.5 inches, at least 1 inch, at least 1.5 inches, at least 2 inches, at least 2.5 inches, or at least 3 inches of the set of cables received by the cable receiving portion may extend and/or be exposed between the communication connector and the cable receiving portion of the strain relief device.

The cable receiving portion is sized and dimensioned to receive and/or hold and/or support a set of cables extending from a side of the communication connector, for example, a rear side of an insert on the communication connector. The cable receiving portion can comprise any component capable of receiving a set of cables and supporting the set of cables at a predetermined distance away from the communication connector. For example, the cable receiving portion can comprise a clamp, a ring, a piece of material (e.g., padding, rubber) with openings for receiving one or more cables, a series of clamps and/or rings, a series of padding components with openings, and/or any other suitable component(s). The set of cables can comprise any number of cables (e.g., at least 4, at least 8, at least 12, at least 16), and any type(s) of cables (e.g., fiber optic cables, data cables, power cables). As used herein, the term "cable" should be interpreted broadly to include a wire and/or a cable.

The base portion and communication connector are coupled together via one or more fasteners. Where the base portion and communication connector have complementary fastener components, a single fastener can fasten with fastener components of each of the base portion and the communication connector. The term "fastener" should be interpreted broadly to include any item that is suitable for securing two components together, among other things, a screw, an adhesive, a heating element (e.g., to weld components together).

Figure 1B:
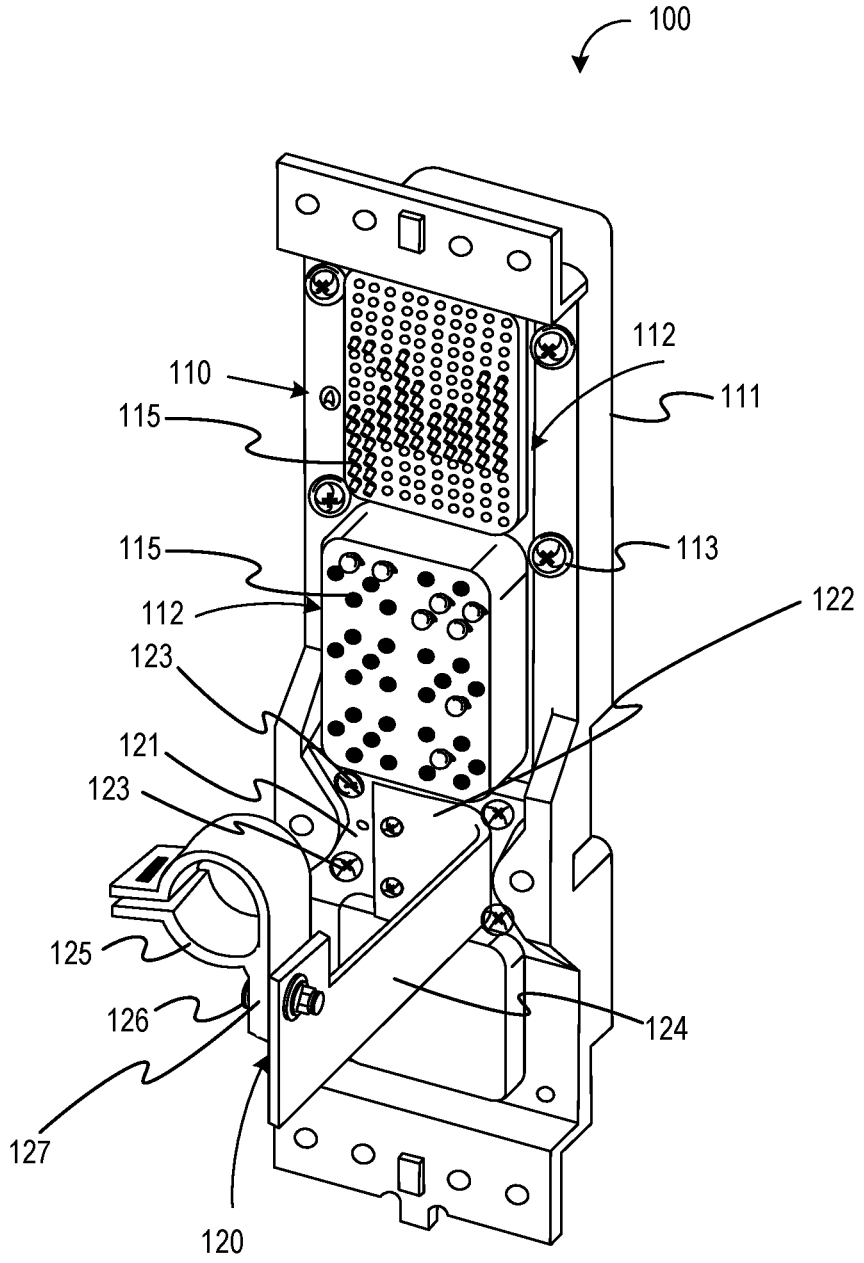
FIG. 1B is a perspective view of the strain relief device and communication connector of FIG. 1A.
Figure 1C:
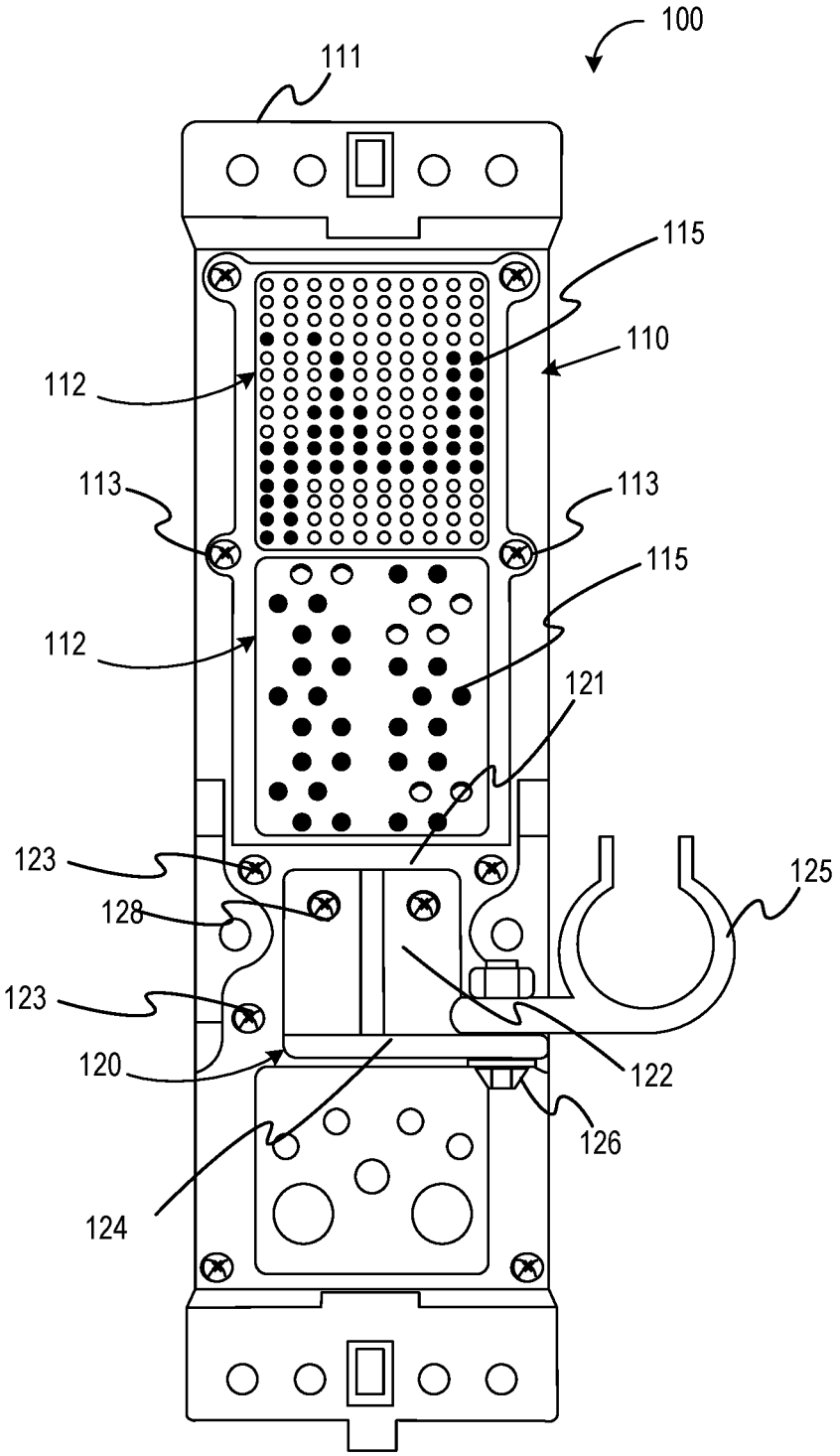
FIG. 1C is a rear view of the communication connector and strain relief device of FIG. 1A with the strain relief device rotated relative to the communication connector.

Referring now to FIGS. 1A-1C, an embodiment 100 of a communication connector 110 having a strain relief device 120 fastened thereto is illustrated. FIGS. 1A-1B illustrates strain relief device 120 coupled with a rear side of communicator connector 110. FIG. 1C illustrates embodiment 100 with a position and/or orientation of strain relief device modified from FIGS. 1A-1B.

Communication connector 110 comprises a shell 111, a set of inserts 112 including contact pins 115 and coupled to shell 111, a set of fastener components, and a set of fasteners 113 for keeping the insert connected to shell 111.

Strain relief device 120 comprises base portion 121, arm portion 124, and a cable receiving portion 125. Strain relief device 120 may be made of any suitable materials (e.g., rubber, silicone, plastic, metal), and is preferably lightweight so as to not add substantial weight to the communication connector. For example, strain relief device 120 may comprise an injection molded or 3-D printed plastic. Additionally, strain relief device 120 may comprise any number of pieces of material, for example, a single piece of material forming the base, arm and cable receiving portions, or a multi-piece device having components coupled with one another, optionally adjustably.

Cable receiving portion 125 is coupled to arm portion 124 via a connector portion 127 (here a small piece of material) that extends from cable receiving portion 125 and includes a fastener component. Connector portion 127 couples with arm portion 124 (or a connection portion thereof) via a fastener 126 that extends through complementary fastener components of connector portion 127 and arm portion 124 (or a connection portion thereof). In some embodiments, the connector portion 127 that extends from cable receiving portion 125 is made from the same piece of material as cable receiving portion. In some other embodiments, the connector portion 127 and cable receiving portion are made from different pieces of material. In some aspects, the arm portion and the connector portion are fixedly coupled to one another such that the components do not move relative to one another. In some aspects, the arm portion and the connector portion can be adjustably coupled with one another to allow a user to modify a position of the cable receiving portion 125 relative to the communication connector. For example, the arm portion 124 (or a connector portion extending from arm portion) and connector portion 127 may be rotatably and/or slidably coupled to one another to allow an angle between the arm portion 124 and connector portion and/or a vertical position of the cable receiving portion relative to insert 112 to be adjusted.

In the embodiment shown in FIGS. 1A-1C, cable receiving portion 125 comprises a clamp that is movable between its default configuration (shown) and a stretched position wherein the clamp opening is widened to allow cables to more easily be placed within the cable receiving portion. Cable receiving portion 125 is biased to be in the default configuration, but can temporarily be modified to the stretched position by a user. Other exemplary cable receiving portions are further shown and described herein.

Base portion 121 comprises a set of fastener components sized and dimensioned to receive fasteners 123. Fasteners 123 may be identical to fasteners 113 or may be different (e.g., longer to additionally extend through fastener components of base portion 121). Although not shown in the drawing, communication connector 110 comprises fastener components (e.g., screw receiving through holes) that align with the fastener components of base portion 121, and are sized and dimensioned to receive fasteners 123. Thus, fasteners 123 extend through and fasten with fastener components of the base portion and complementary fastener components of the communication connector. In the embodiment shown, base portion 121 is coupled with another connector portion 122 that extends substantially orthogonally to an effective length of arm portion 124 via fasteners 128. As an example, the connector portion that extends substantially orthogonally to an effective length of arm portion 124 can comprise a bent portion of arm portion. Having a base portion 121 that is separate from, and coupled to, connector portion 122, which couples with arm portion 124 of the device as shown in FIGS. 1A-1C can be beneficial in many instances. For example, having separate pieces of material for the base portion and connector portion can allow the base portion to remain fastened to the communication connector via fastener components already existing on communication connector 110, while allowing a user to adjust an orientation and/or position of the cable receiving portion 125 (as shown in FIG. 1B vs. FIG. 1C) by moving/rotating the connector portion 122 relative to base portion 121. Multiple sets of fastener components may be included on base portion 121 such that connector portion 122 can couple with base portion 121 via different sets of fastener components at different positions. FIG. 1C shows connector portion 122 coupled to different fasteners than in FIGS. 1A-1B such that the arm portion 124 and cable receiving portion 125 are rotated 90 degrees relative to the communication connector.

Figure 2B:
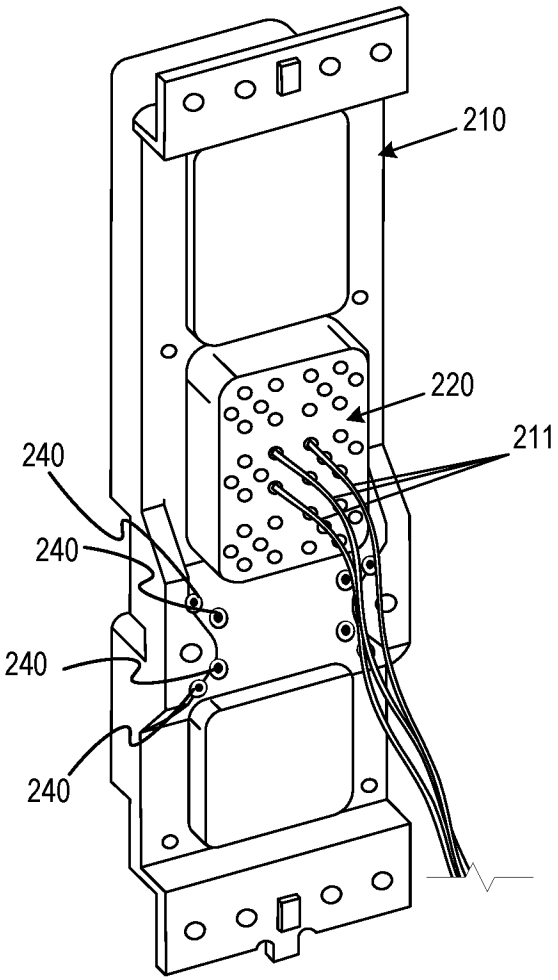
FIG. 2B is a perspective view of the communication connector and cables of FIG. 2A without the strain relief device of FIG. 2A.
Figure 2A:
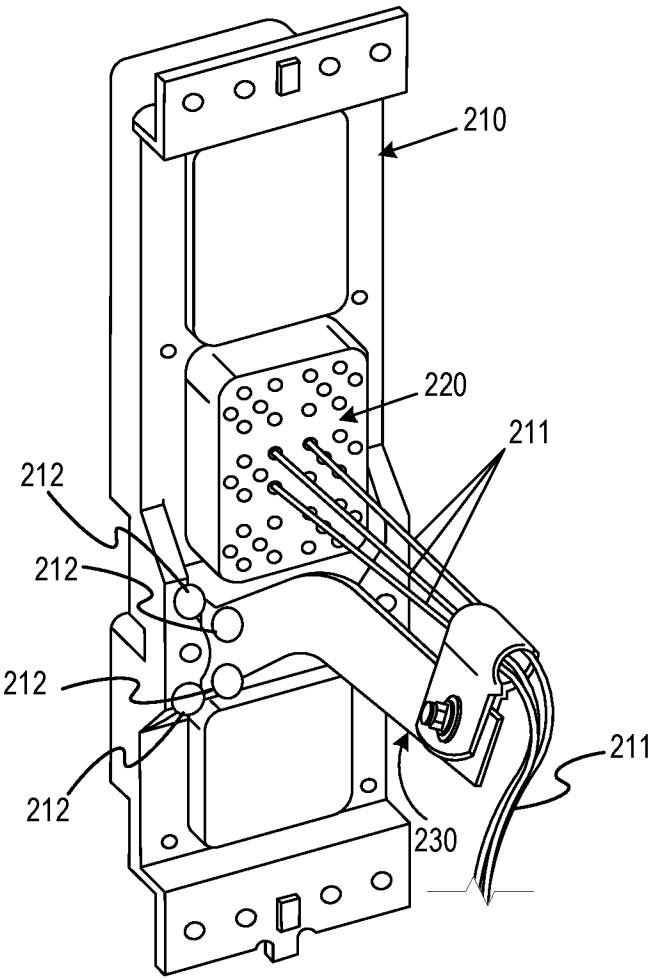
FIG. 2A is a perspective view of a communication connector including cables and a strain relief device coupled to the communication connector, according to an embodiment.

Referring to FIGS. 2A-2B, a communication connector with and without a strain relief device is illustrated to clearly show how a set of cables is better supported by the strain relief device. In FIG. 2A, communication connector 210 includes insert 220, and a set of cables 211 extending out of a set of openings and/or contacts and/or pins on a first side of the insert of a communication connector. A strain relief device 230 is coupled with the communication connector 210 via fastener components 240 that already exist on communication connector 210, a set of complementary fastener components on a base portion of strain relief device 230, and a set of screw fasteners 212 that mate with the fastener components of the base portion and the communication connector. FIG. 2B illustrates communication connector 210 and set of cables 211 without a strain relief device 230 coupled to the communication connector 210. The set of cables 211 in FIG. 2A are supported and extend substantially orthogonally to the communication connector 210 for a predetermined distance between insert 220 of communication connector 210 and the cable receiving portion of strain relief device 230. In contrast, the set of cables 211 in FIG. 2B are not sufficiently supported and begin to drop adjacent to insert 220, which can more easily lead to damage and/or breakage of the cables during installation, use, removal, and/or transport of the communication connector 210. Movement (e.g., wiggling) of cables 211 past the cable receiving portion of strain relief device 230 moves the stress point away from the contact pins within insert 220 so the cables do not break.

Figure 3:
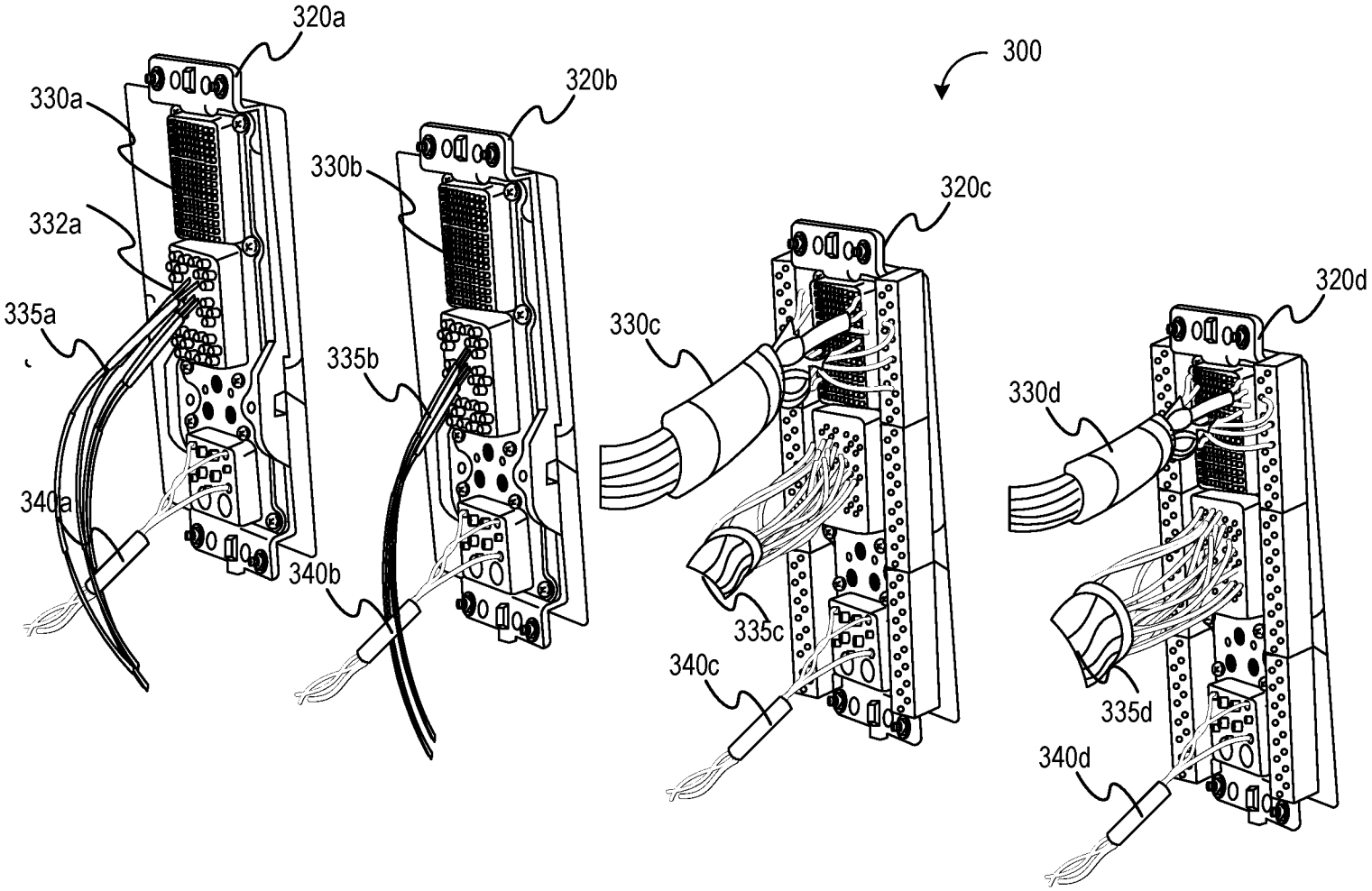
FIG. 3 is a perspective view of a set of communication connectors on a rack (not shown), each communication connector coupled to sets of cables, according to an embodiment without strain relief.

FIG. 3 illustrates an environment 300 in which a set of communication connectors (320*a*, 320*b*, 320*c*, 320*d*) are positioned on a rack panel (not shown). The communication connectors 320*a*, 320*b*, 320*c* and 320*d* include inserts (e.g., 330*a*, 330*b*) including contacts, and are coupled with one or more sets of cables (e.g., 335*a*, 340*a*, 335*b*, 340*b*, 330*c*, 335*c*, 340*c*, 330*d*, 335*d*, 340*d*). As clearly illustrated with communication connector 320*a*, cables extending from connectors where a strain relief device is not provided are more vulnerable to breakage and/or damage as the cables are not supported away from communication connector 320*a*. Without a strain relief device, wiggling or other movement of the cables can cause the cables and/or contacts (e.g., pin of contact) the cables are coupled with to break.

Figure 4:
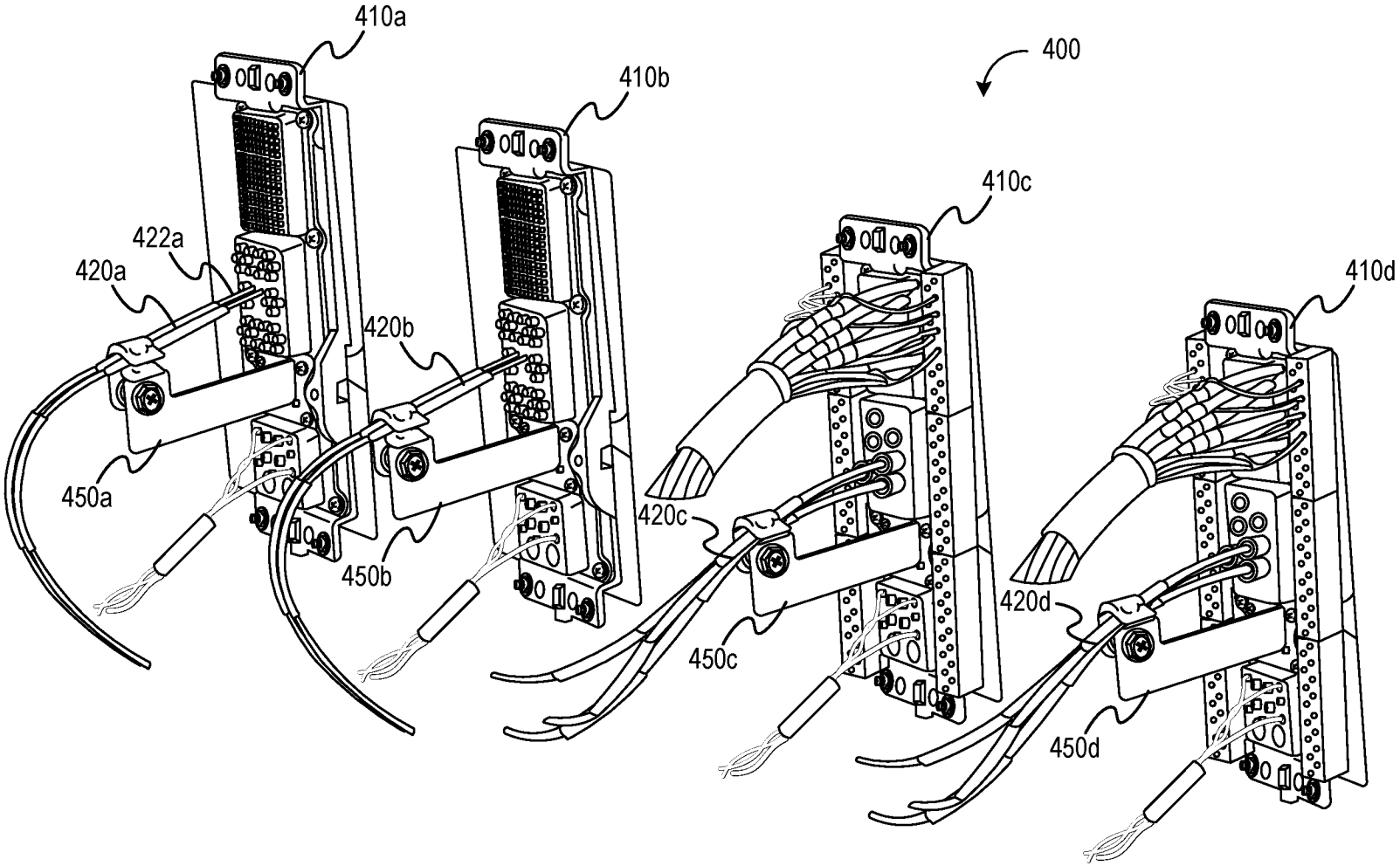
FIG. 4 is a perspective view of a set of communication connectors on a rack (not shown), each communication connector coupled to sets of cables and a strain relief device, according to an embodiment.

FIG. 4 illustrates an environment 400, which is similar to environment 300 but further includes strain relief devices coupled to the communication connectors. In environment 400, a set of communication connectors (410*a*, 410*b*, 410*c*, 410*d*) are positioned on a rack panel (not shown). The communication connectors 410*a*, 410*b*, 410*c*, 410*d* include inserts, and are coupled with one or more sets of cables (e.g., 420*a*, 420*b*, 420*c*, 420*d*). The cables are supported between the communication connector and a predetermined point by strain relief devices (e.g., 450*a*, 450*b*, 450*c*, 450*d*). As clearly illustrated with communication connector 410*a*, cables extending from connectors where a strain relief is provided are less vulnerable to breakage and/or damage. Communication connector 410*a* includes inserts that have contacts and are configured to couple with optical, data, power and/or other communication cables. One or more inserts are coupled to sets of cables 420*a*, which extend at an angle of between 70-110 degrees (e.g., between 80-100 degrees) relative to a length of the insert between the insert and cable receiving portion of strain relief device 450*a*. Strain relief device 450*a* thereby provides strain relief, especially at point 422*a* where the set of cables couple with the communication connector. The addition of strain relief devices to the communication connectors of environment 400 advantageously reduces incidences of breakage and/or other damage during use, installation, removal, and/or transport of the connectors and cables as compared to the communication connectors of environment 300.

Figure 5:
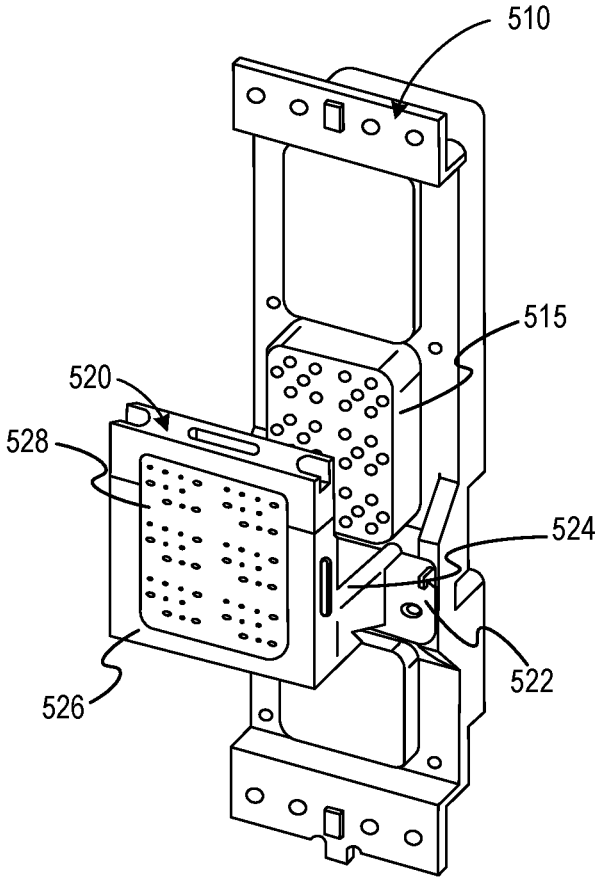
FIG. 5 is a perspective view of the strain relief device and communication connector, according to an embodiment.

Referring now to FIG. 5, a strain relief device of another embodiment is illustrated on a communication connector. Communication connector 510 includes insert 515, which is sized and dimensioned to receive a set of cables (e.g., via contacts). Strain relief device 520 includes a base portion 522, arm portion 524, and a cable receiving portion 526. The base portion 522 includes fastener components that align with fastener components of communication connector 510. The strain relief device 520 is secured to communication connector 510 via the aligned fastener components and one or more fasteners. The cable receiving portion 526 includes a material 528 (e.g., foam padding, rubber, soft plastic) having a set of openings, each of which is sized and dimensioned to receive and hold one or more cables. In some contemplated embodiments, each opening may be between 100% and 500% of a diameter of at least one cable (e.g., between 110% and 250%, between 1-20 mm, between 1-15 mm, between 1-10 mm). The openings will preferably be sized such that the one or more cables are held but not tightly gripped by the cable receiving portion. The openings may be positioned and/or arranged to align with the openings of insert 515 such that the cables extend out of cable receiving portion 526 in the same or similar manner the cables extend out of the communication connector 510. Viewed from a different perspective, cable receiving portion 526 may be configured to maintain a straightness of the set of cables between insert 515 and cable receiving portion 526. Preferably the strain relief device may remain secured to communication connector 510 even while one or more cables are removed, repaired, and/or replaced.

Figure 6:
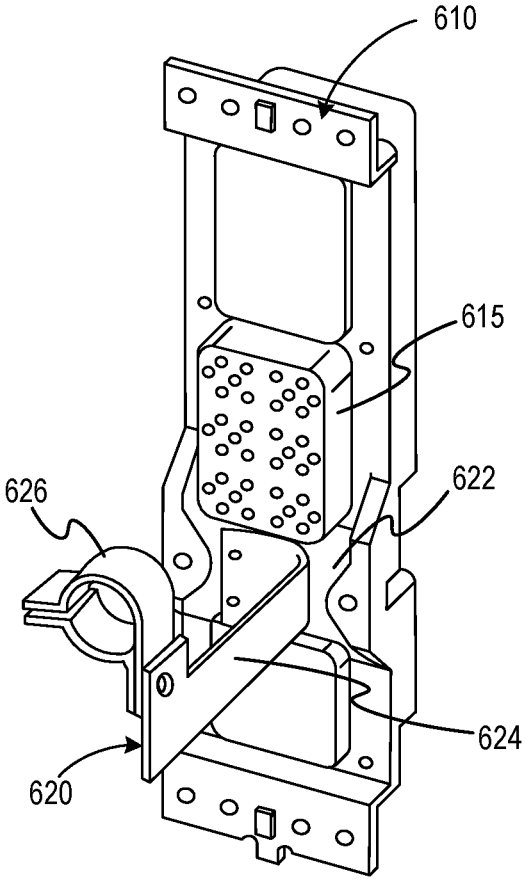
FIG. 6 is a perspective view of the strain relief device and communication connector, according to an embodiment.

Referring now to FIG. 6, a strain relief device of another embodiment is illustrated on a communication connector. Communication connector 610 includes insert 615, which is sized and dimensioned to receive a set of cables. Strain relief device 620 includes a base portion 622, an arm portion 624, and a cable receiving portion 626. Base portion 622 is coupled to communication connector 610 via one or more fasteners, and is also coupled with a connector portion that is substantially orthogonal from arm portion 624 or an effective length of arm portion 624. The connector portion may comprise the same piece of material as arm portion 624, or can comprise a separate piece coupled to arm portion 624. Arm portion 624 is also coupled with cable receiving portion 626, which comprises a clamp and is configured to receive a set of cables extending from insert 615. Cable receiving portion may be positioned about 1-5 inches from insert 615 at about the same height as a portion of insert 615. For example, when strain relief device is coupled with communication connector 610, the side edge of the cable receiving portion 626 closest to insert 615 may be positioned about 1.5-5 inches away from a side of insert 615 that faces cable receiving portion 626. The portions of the set of cables extending between insert 615 and cable receiving portion 626 may form an angle of between 60-120, between 70-110, between 80-100, or about 90 degrees with the side of insert 615 and/or communication connector 610 facing cable receiving portion 626. The movement of the set of cables between the first side of the communication connector and the cable receiving portion is thereby reduced by strain relief device, and breakage of the cables and/or contact pins can effectively be avoided.

Figure 7:
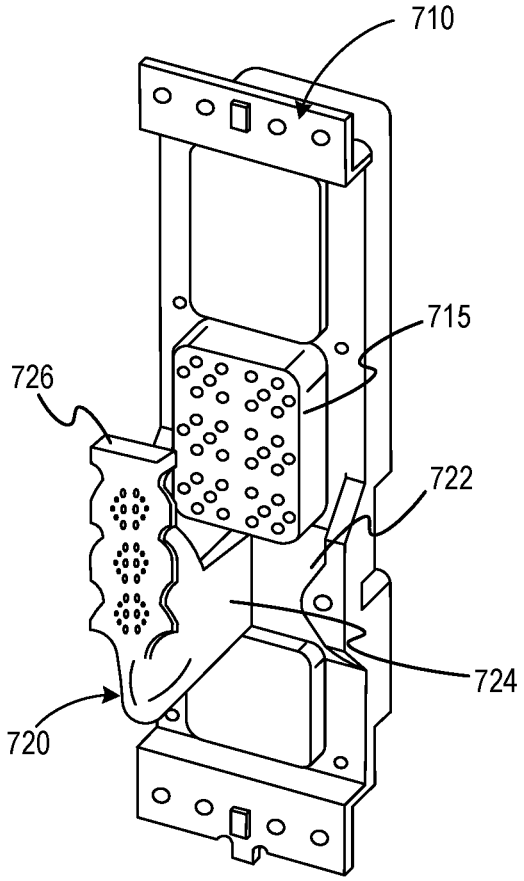
FIG. 7 is a perspective view of the strain relief device and communication connector, according to an embodiment.

Referring now to FIG. 7, a strain relief device of another embodiment is illustrated. Communication connector 710 includes insert 715 through which a set of cables extends (not shown). A base portion 722 of strain relief device 720 is coupled to communication connector 710 at a position below insert 715 via a fastener. Base portion 722 is further coupled to arm portion 724, which extends between base portion 722 and cable receiving portion 726. Cable receiving portion 726 includes one or more vertically arranged sets of openings, wherein each opening of the set of openings is sized and dimensioned to receive one or more cables extending from insert 715. A set of openings on cable receiving portion 726 may have the same arrangement or pattern as a set of openings on insert 715. The vertically arranged sets of openings on cable receiving portion 726 may substantially horizontally align with sets of openings on inserts 715 such that each cable of the set of cables extends at substantially the same angle from insert 715.

Figure 8:
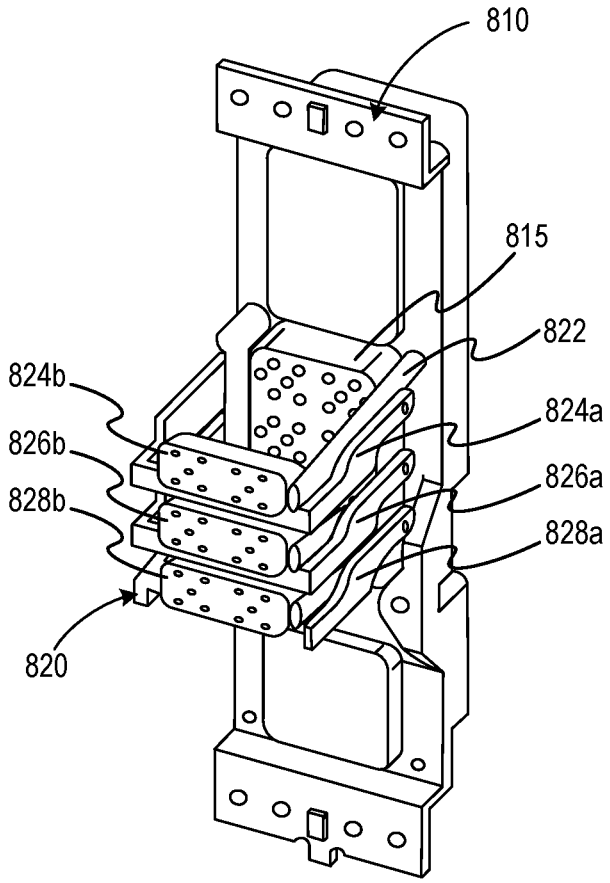
FIG. 8 is a perspective view of the strain relief device and communication connector, according to an embodiment.

Referring now to FIG. 8, a strain relief device of yet another embodiment is illustrated. Communication connector 810 comprises an insert 815, which is sized and dimensioned to receive one or more sets of cables. Strain relief device 820 includes one or more base portions 822, which couples to communication connector 810. Strain relief device 820 further comprises 3 pairs of arms 824*a*, 826*a*, and 828*a*, which couple with 3 cable receiving portions 824*b*, 826*b*, and 828*b*. It should be appreciated that a strain relief device of the inventive subject matter may have any suitable number of base elements, arms, and cable receiving portions, and that the components can be arranged in any suitable manner (e.g., vertically, horizontally). Each cable receiving portion includes multiple openings, each of which is sized and dimensioned to receive a cable extending from a first side of communication connector 810 (e.g., from a first side of insert 815). In some other embodiments, each of the cable receiving portion may include a single opening sized and dimensioned to receive a set of cables (e.g., at least 4, at least 8, at least 12, at least 16, at least 20, at least 24, at least 36 cables). In some other embodiments, one or more cable receiving portions may include a single opening, and one or more cable receiving portions may include multiple openings.

Thus, various embodiments of strain relief devices of the inventive subject matter have been disclosed herein. Although particular embodiments have been shown and described, it is to be understood that the above description is not intended to limit the scope of these embodiments. While embodiments and variations of the many aspects of the invention have been disclosed and described herein, such disclosure is provided for purposes of explanation and illustration only. Thus, various changes and modifications may be made without departing from the scope of the claims. For example, not all of the components described in the embodiments are necessary, and the invention may include any suitable combinations of the described components, and the general shapes, relative positions, and relative sizes of the components of the invention may be modified. Accordingly, embodiments are intended to exemplify alternatives, modifications, and equivalents that may fall within the scope of the claims. The invention, therefore, should not be limited, except to the following claims, and their equivalents.

Thus, the claims are not intended to be limited to the aspects shown herein, but are to be accorded the full scope consistent with the language of the claims, wherein reference to an element in the singular is not intended to mean "one and only one" unless specifically so stated, but rather "one or more." Unless specifically stated otherwise, the term "some" refers to one or more.

What is claimed is:

1. A strain relief device for a communication connector, comprising:

a base portion, a cable receiving portion, and an arm portion extending between the base portion and the cable receiving portion;

wherein the base portion is configured to couple with the communication connector via a first fastener;

wherein the cable receiving portion is positioned at least an inch away from the communication connector when the base portion is coupled to the communication connector via the first fastener;

wherein the cable receiving portion is sized and dimensioned to receive a set of cables extending from a first side of the communication connector, wherein the set of cables extends through an insert of the communication connector, and wherein the strain relief device further comprises a second cable receiving portion sized and dimensioned to receive a second set of cables extending from the first side of the communication connector, or wherein the base portion comprises a separate piece of material from the arm portion, or wherein the insert comprises a first set of openings for receiving the set of cables, and wherein the cable receiving portion comprises a second set of openings having the same arrangement as the first set of openings.

2. The strain relief device of claim 1, wherein the base portion comprises a first fastener component that aligns with a second fastener component of the communication connector, and wherein each of the first and second fastener components is sized and dimensioned to mate with the first fastener.

3. The strain relief device of claim 1, wherein the set of cables comprises at least one of fiber optic cables, data cables, and power cables.

4. The strain relief device of claim 1, wherein the first fastener is a screw, and wherein the strain relief device remains attached to the communication connector when the communication connector is transported or removed from a rack tray.

5. The strain relief device of claim 1, wherein the cable receiving portion is positioned at least an 1.5 inches away from the communication connector when the base portion is coupled to the communication connector.

6. The strain relief device of claim 1, wherein the cable receiving portion is positioned at least an 2 inches away from the communication connector when the base portion is coupled to the communication connector.

7. The strain relief device of claim 1, wherein the strain relief device is made of at least one of rubber, silicone, plastic, and metal.

8. The strain relief device of claim 1, wherein the strain relief device is injection molded.

9. The strain relief device of claim 1, wherein each cable of the set of cables extends from the first side of the communication connector to the cable receiving portion at about a 90 degree angle relative to the first side of the communication device, and wherein movement of the first set of cables between the first side of the communication connector and the cable receiving portion is reduced by the strain relief device.

10. The strain relief device of claim 1, wherein the cable receiving portion comprises a separate piece of material from the arm portion.

11. The strain relief device of claim 1, wherein the base portion and arm portion are made of a single piece of material.

12. The strain relief device of claim 1, wherein the first fastener comprises at least one of an adhesive and a screw.

13. A strain relief device for a communication connector, comprising:

a base portion, a cable receiving portion, and an arm portion extending between the base portion and the cable receiving portion;

wherein the base portion is configured to couple with the communication connector via a first fastener;

wherein the cable receiving portion is positioned at least an inch away from the communication connector when the base portion is coupled to the communication connector via the first fastener;

wherein the cable receiving portion is sized and dimensioned to receive a set of cables extending from a first side of the communication connector, wherein the set of cables extends through an insert of the communication connector, and wherein the cable receiving portion comprises a foam material including an opening sized and dimensioned to receive at least one cable of the set of cables.

14. The strain relief device of claim 13, wherein the opening is sized and dimensioned such that the at least one cable of the set of cables is held but not gripped.

15. The strain relief device of claim 14, wherein the opening is between 100% and 500% of a diameter of the at least one cable.

16. A strain relief device for a communication connector, comprising:

a base portion that couples to the communication connector via a fastener that fastens with each of a first fastener component of the base portion and a second fastener component of the communication connector; and a cable receiving portion positioned at least 1 inch further from a first side of the communication connector than the base portion, wherein the cable receiving portion is sized and dimensioned to support a set of cables extending from the first side of the communication connector to provide strain relief and prevent damage to the set of cables, wherein the set of cables extends through an insert of the communication connector, wherein the insert comprises a first set of openings for receiving the set of cables, and wherein the cable receiving portion comprises a second set of openings having a same arrangement as the first set of openings.

* * * * *